United States Patent [19]

Prater

[11] 4,088,369

[45] May 9, 1978

[54] OSCILLATING MECHANISM FOR STRIPPING MACHINE

[75] Inventor: Earle F. Prater, Long Beach, Calif.

[73] Assignee: Roofing Equipment, Inc., Denver, Colo.

[21] Appl. No.: 757,209

[22] Filed: Jan. 6, 1977

[51] Int. Cl.[2] ..... A47L 11/12

[52] U.S. Cl. ..... 299/37; 15/93 R; 30/170; 30/272 R

[58] Field of Search ..... 299/37; 15/93 R; 30/169–172, 272 R, 272 A

[56] References Cited

U.S. PATENT DOCUMENTS

| | | | |
|---|---|---|---|
| 968,422 | 8/1910 | Rosenholz | 299/37 |
| 3,195,232 | 7/1965 | Toth | 30/169 |
| 3,733,637 | 5/1973 | Becker | 299/37 X |

*Primary Examiner*—Ernest R. Purser

*Attorney, Agent, or Firm*—Christie, Parker & Hale

[57] ABSTRACT

A machine for removing cemented carpets, tiles and like coverings from a floor or other surface. A cam is mounted on the shaft of a drive motor secured to a frame of the machine. A blade-carrying bracket is pivotably mounted on the frame, and a follower block is rigidly secured to the bracket. The follower block has an oblong opening to receive the cam, and to translate rotary motion of the cam into reciprocating motion of the blade.

8 Claims, 11 Drawing Figures

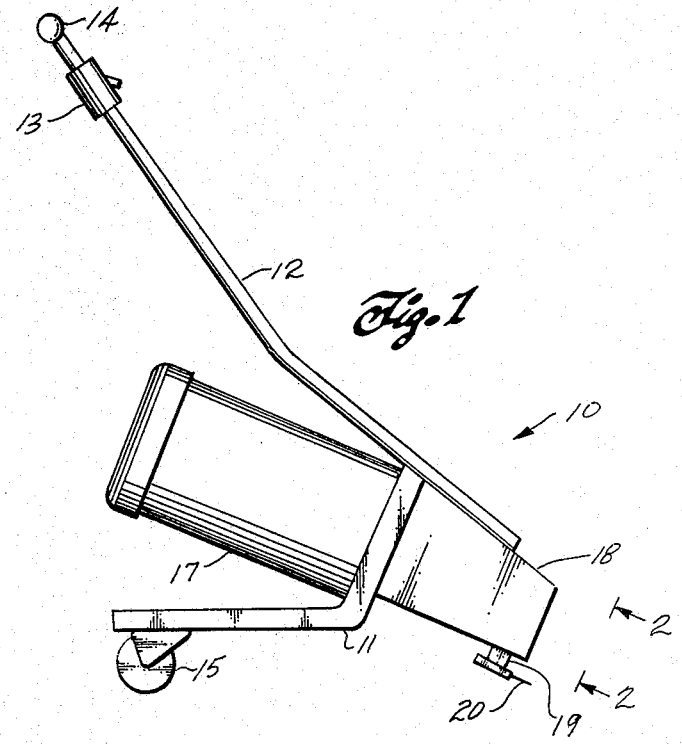
Fig. 1
Fig. 2
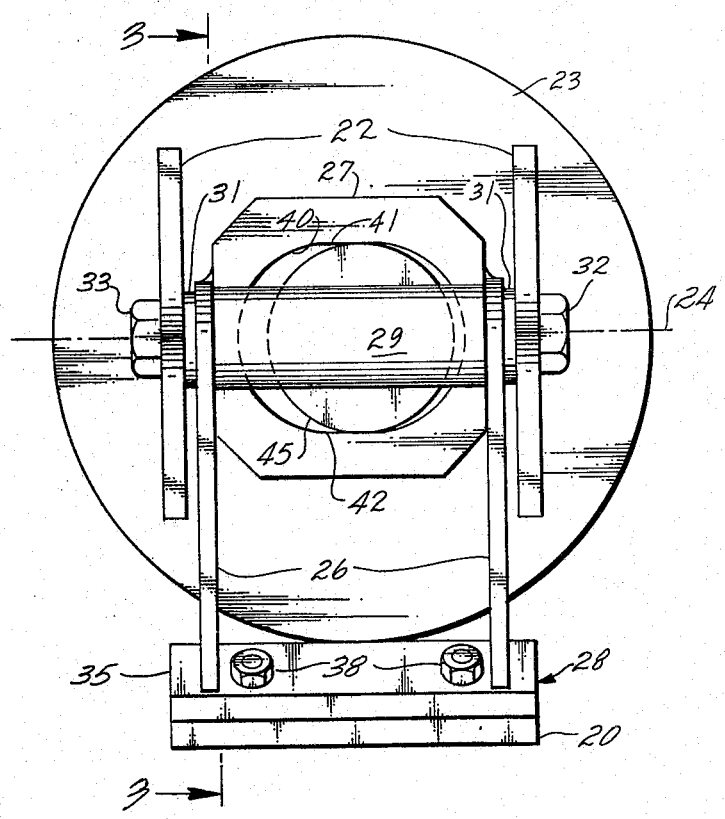

OSCILLATING MECHANISM FOR STRIPPING MACHINE

BACKGROUND OF THE INVENTION

Floor coverings such as carpets, linoleum and tile are frequently adhesively secured to the underlying floor to achieve a stable and long-lasting bond without use of nails or other fasteners. Commercially available cements for this purpose produce a good bond of the floor covering, but it is difficult and time-consuming to break the adhesive bond manually when the floor covering becomes worn and must be replaced. Floor-stripping machines have accordingly been developed for this purpose, and representative examples are shown in U.S. Pat. Nos. 2,777,680, 3,376,071 and 3,733,637.

Known floor-stripping machines typically include a wheel-supported frame having a handle so the machine can be guided and steered by an operator. A drive motor is carried by the frame, and the motor is coupled to a stripping blade through an oscillating mechanism which reciprocates the blade. The coupling device typically include pulleys, belts, springs, and the like, and these mechanisms are expensive to produce and maintain.

The oscillating mechanism of this invention enables simplification and reduction of the members of parts needed for coupling a rotary drive motor to a reciprocating blade in a stripping machine. Use of the mechanism enables production of these machines at a significantly lower factory cost, and without the reliability and servicing problems which characterize the more complex designs of the prior art.

SUMMARY OF THE INVENTION

Briefly stated, the machine of this invention includes a frame, and a drive motor secured to the frame and having a rotary drive shaft extending therefrom. A cam is secured to the motor shaft, and has a peripheral surface which is eccentric with respect to the drive-shaft axis of rotation. A bracket is pivotally mounted on the frame for oscillation with respect to the frame about a pivot axis which is substantially perpendicular to the drive shaft axis of rotation, and a stripping blade is mounted at a lower end of the bracket. A cam-follower block is secured to the bracket, and the block has an oblong opening therein to receive the cam. The longer axis of the cam opening is substantially parallel to the bracket pivot axis, and is sufficiently large that the ends of the opening remain clear of the rotating cam. The cam opening further defines upper and lower side surfaces which are substantially straight and parallel, the side surfaces being spaced apart by substantially the outside diameter of the cam, whereby the cam makes a rotatable slip fit between the side surfaces, thereby oscillating the bracket about the pivot axis to reciprocate the stripping blade.

In a presently preferred form, the bracket is shaped as a bell crank with the follower block secured adjacent one end and a blade secured adjacent the opposite end, the bracket pivot axis being positioned approximately on and normal to the drive shaft axis of rotation. Preferably, the frame includes a pair of plates extending along opposite sides of the bell-crank bracket to form a forked support for the bracket. In one form, the bell-crank bracket includes a pair of spaced-apart side plates which are connected by the follower block, a clamping jaw for the stripping blade, and a tubular member at the bracket pivot axis. A bearing means such as a pair of sleeve bearings are provided to interconnect the tubular member and the plates of the forked bracket support.

Preferably the cam includes a conventional ball-bearing assembly positioned over the outer surface of the cam to be disposed between the cam and follower block. The bearing member is confined on the cam against axial movement by a radially extending flange on the cam, and a snap-ring fastener secured to the cam.

BRIEF DESCRIPTION OF THE DRAWINGS

FIG. 1 is a side elevation of a stripping machine incorporating an oscillating mechanism according to the invention;

FIG. 2 is a front view of the oscillating mechanism on line 2—2 of FIG. 1 and with a guard housing removed;

DESCRIPTION OF THE PREFERRED EMBODIMENT

Figure 3:
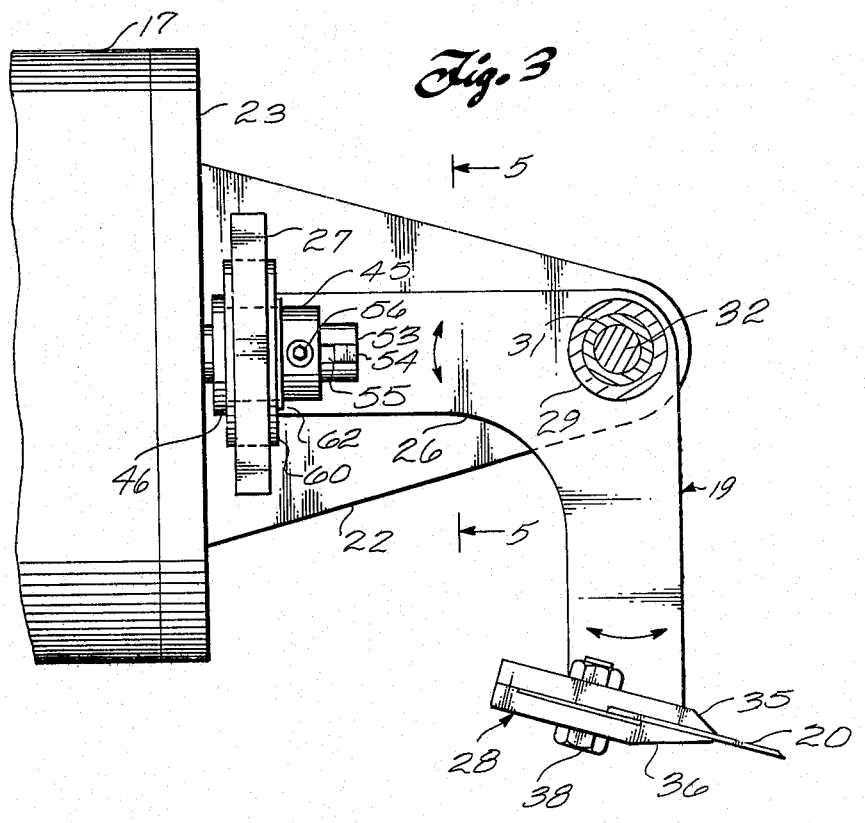
FIG. 3 is a side elevation of the mechanism, partly in section, on line 3—3 of FIG. 2.

FIG. 1 shows a stripping machine 10 of a style adapted to incorporate the oscillating mechanism of this invention. The machine includes a frame 11 with an elongated handle 12 extending upwardly and rearwardly therefrom. A conventional power switch 13 and hand grip 14 are mounted at the upper end of the handle. A pair of wheels 15 are mounted at the rear undersurface of the frame so the machine can be rolled along a floor.

A drive motor 17 of a conventional type extends upwardly and rearwardly from a forward part of the frame. An end-mounted motor of about one-half horsepower and about 1750 rpm is suitable for most carpet-stripping applications, but three-fourths or one-horsepower motors may be used for heavy duty work. A removable guard housing 18 extends forwardly from the frame and motor to enclose the oscillating mechanism described below. A stripping-blade bracket 19 carrying a blade 20 extends through an opening in the bottom of the guard housing.

The oscillating mechanism of this invention is shown in greater detail in FIGS. 2–5. Frame 11 includes a pair of blade-bracket support plates 22 rigidly secured (as by welding or the like) to a circular plate 23 attached to the front end of drive motor 17. The plates form a fork-like support for the blade bracket. In the configuration shown in FIGS. 2–5, the stripping-blade bracket is shaped as a bell crank with a pivot axis 24. The bracket is made up of a pair of spaced-apart sideplates 26 which are connected together at one end by a cam-follower block 27, at the opposite end by a blade-clamping assembly 28, and at the pivot axis by a hollow cylindrical tube 29. These parts of the bracket are all rigidly secured together by welding or any conventional attachment means.

The ends of tube 29 are counterbored to receive a pair of tubular flanged-head bearings 31 (an "Oilite" bearing such as a Boston FB-812-8 is satisfactory). These components are clamped together by a through bolt 32 and a locking nut 33. Blade-clamping assembly 28 includes upper and lower jaw plates 35 and 36, the upper jaw plate being welded to the ends of sideplates 26. Stripping blade 20 is clamped between the jaw plates by a pair of bolts 38. A relatively short (e.g. about 4 inches in length) stripping blade is shown in the drawings but the blade-clamping assembly is readily adapted to carry wider blades as may be desired for certain types of stripping operations.

Cam-follower block 27 (best seen in FIGS. 4 and 5) is welded as described above at the driving end of the stripping-blade bracket. An oblong or racetrack-shaped opening 40 is formed through the block, and the opening has upper and lower side surfaces 41 and 42 which are flat and parallel. The shape of the opposite ends of the opening is not critical, but is normally semi-circular for machining convenience.

Figure 6:
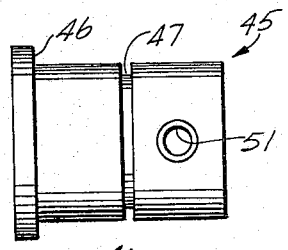
FIG. 6 is a side elevation of a cam.
Figure 7:
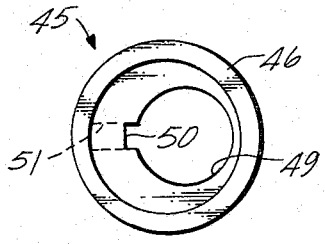
FIG. 7 is an end view of the cam.

A drive cam 45 for the oscillating mechanism is shown in detail in FIGS. 6 and 7. The exterior surface of the cam is cylindrical, and the cam has an enlarged flange 46 at one end. An annular lock-ring groove 47 is cut in the cam surface approximately midway along its length. A cylindrical bore 49 is formed axially through the cam, and the axis of the bore is radially offset from the radial center of the cam outer surface as best seen in FIG. 7. A keyway slot 50 is cut at one side of the bore, and a threaded setscrew opening 51 extends from the outer surface of the cam into the keyway.

In a typical configuration, the cam has an outside diameter of about 1 inch, with the flange diameter being about 1¼ inch, and the diameter of bore 49 is about 0.625 inch, with the bore axis being offset about 0.125 inch from the axis of the cam outer surface.

Figure 4:
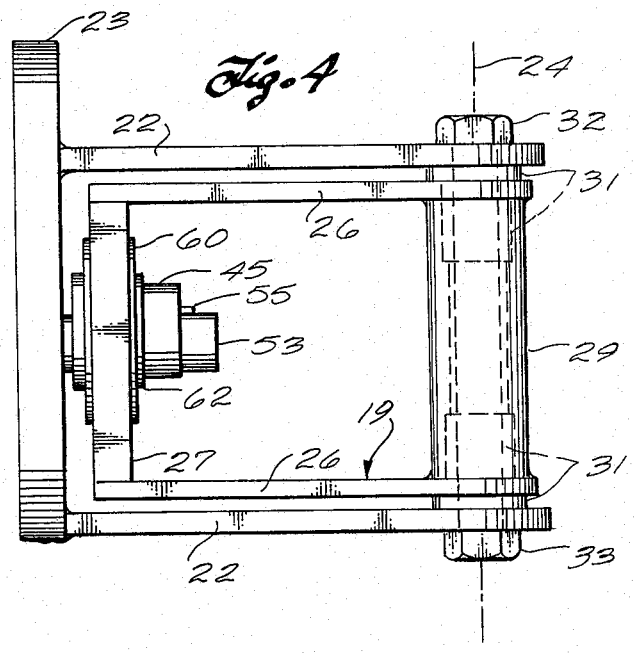
FIG. 4 is a top view of the mechanism.
Figure 5:
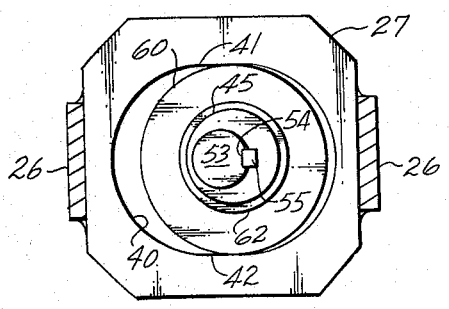
FIG. 5 is a partial front view, partly in section, on line 5—5 of FIG. 3.

Drive motor 17 has an output shaft 53 which extends through an opening in plate 23, and cam 45 is mounted on the shaft as shown in FIGS. 3–5. A keyway slot 54 is cut in the outer end of the motor output shaft, and the cam and shaft are rotationally locked together by a key 55 fitted into slots 50 and 54, and a set screw 56 threaded into opening 51 also locks the cam to the shaft.

A rotary ball bearing assembly 60 has an inner race which makes a slip fit over the outer surface of cam 45. The outer race of the bearing assembly fits within opening 40 of the cam-follower block. A conventional ball bearing such as a Boston 1641DS is satisfactory for assembly 60.

The outside diameter of bearing assembly 60 is typically about 2 inches, and the spacing of upper and lower side surfaces 41 and 42 of opening 40 is slightly larger (typically by about 0.020-inch) than the bearing diameter to compensate for the slight rocking motion of the cam-follower block when the machine is operated. Assembly 60 is installed over the cam to abut flange 46, and is locked in position by a C-ring retainer 62 fitted into groove 47 of the cam.

In operation, power is applied to the drive motor to rotate shaft 53 and cam 45, and the cam drives the follower block and stripping-blade bracket in a reciprocating action which oscillates stripping blade 20 along a floor, roof or other substrate from which a covering is being removed. Motion of the cam-follower block and stripping-blade bracket is oscillatory rotary motion about pivot axis 24, and side loads on the bracket are avoided as a result of the clearance between the ends of opening 40 and the cam outer surface.

The desired oscillatory motion of the stripping blade is thus achieved with a minimum number of simple and inexpensive parts which operate together smoothly and reliably without the mechanical complexity which characterizes prior-art designs. Another advantage of this overall arrangement is that the machine has a relatively low center of gravity which tends to stabilize the machine during stripping operations.

Figure 8:
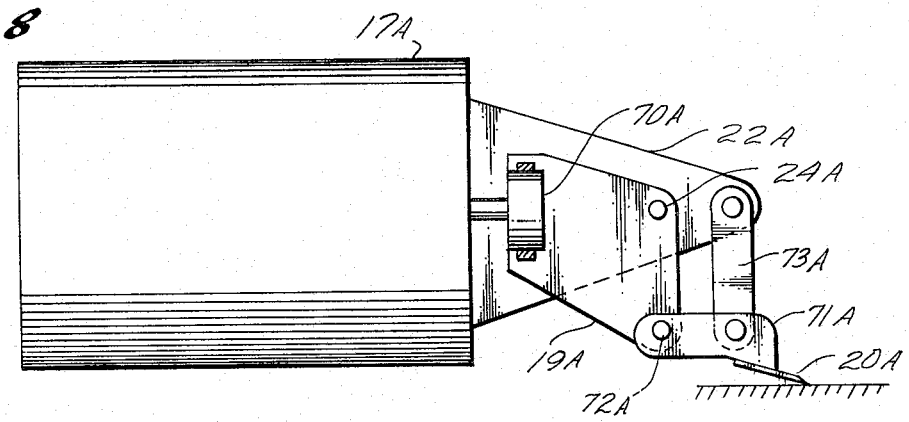
FIG. 8 is a schematic side elevation of an alternative embodiment.

Although the invention has been described in a presently preferred form, the basic concept is useful in various other forms, some of which are schematically illustrated in FIGS. 8–11. FIG. 8 shows drive motor 17A and support plates 22A with a stripping-blade bracket 19A mounted on the support plates at a pivot axis 24A. The motor shaft, cam, bearing assembly and cam-follower block are collectively identified as assembly 70A in this view. Stripping blade 20A is carried by a portion 71A of bracket 19A which is mounted to pivot about an axis 72A of the bracket. The forward ends of bracket portion 71A and side plates 22A are connected by pivotally mounted links 73A, thereby forming a parallelogram linkage which carries the blade. This arrangement enables the blade to be extended more forwardly beyond the front end of the motor if desired.

Figure 9:
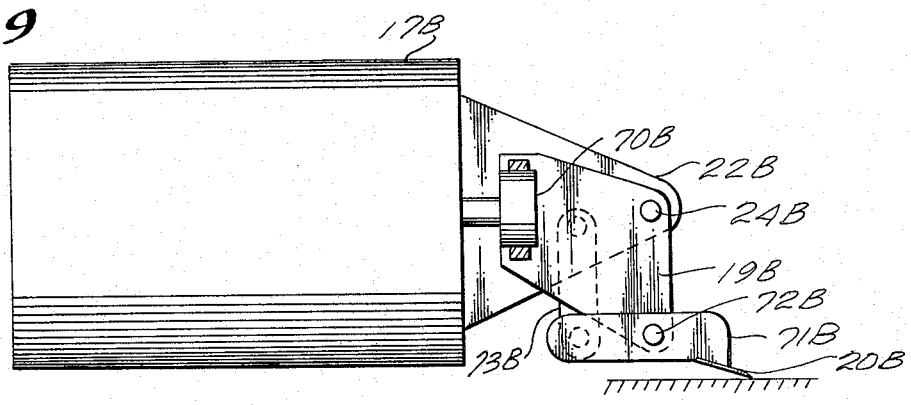
FIG. 9 is a schematic side elevation of a second alternative embodiment.

A similar arrangement is shown in FIG. 9, but links 73B are moved behind the bracket pivot axis. It should be noted that the center-to-center spacing of the two sets of pivot axes in this linkage need not be equal, thereby providing further control over the oscillatory motion of the blade.

Figure 10:
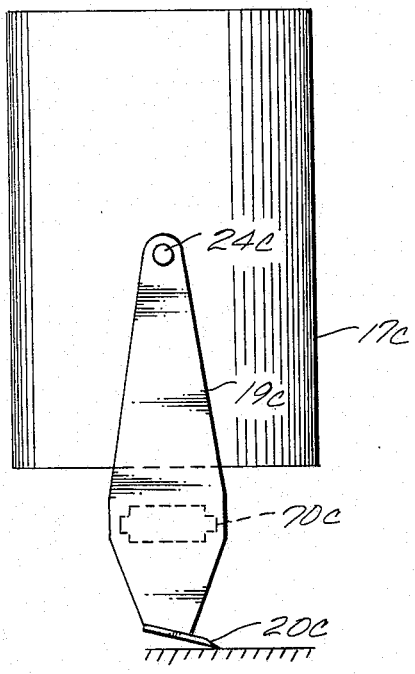
FIG. 10 is a schematic side elevation of a third alternative embodiment.
Figure 11:
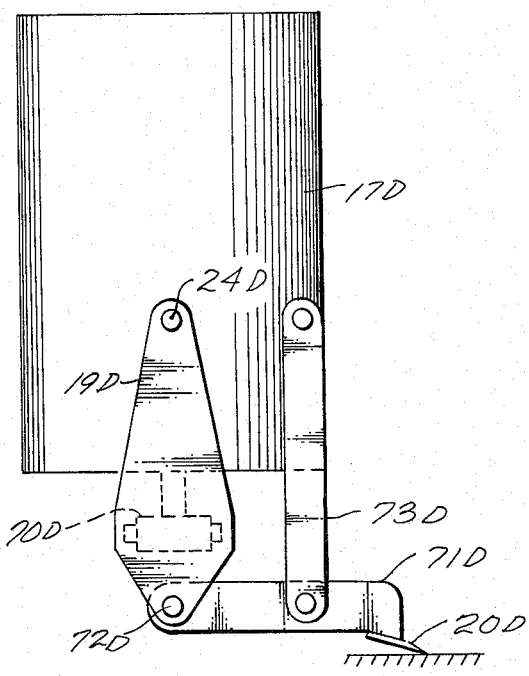
FIG. 11 is a schematic side elevation of a fourth alternative embodiment.

The oscillatory mechanism can also be used with a vertically oriented motor as suggested in FIGS. 10 and 11. In this arrangement, stripping-blade bracket 19C is mounted to move about a pivot axis 24C which is spaced above the lower end of drive motor 17C. Oscillatory-mechanism assembly 70C operates as described above to reciprocate blade 20C. A similar arrangement is shown in FIG. 11, but in this configuration the stripping-blade bracket is articulated about a pivot axis 72D and a pair of pivotally mounted links 73D are added to form the equivalent of a four-bar linkage as described above.

What is claimed is:

1. A machine for stripping carpet, tile, and similar objects which are adhered to a surface, comprising:
   - a frame;
   - a drive motor secured to the frame, the motor having a rotary drive shaft extending therefrom;
   - a cam secured to the motor drive shaft and having a peripheral surface which is eccentric with respect to the drive-shaft axis of rotation;
   - a bracket pivotally mounted on the frame for oscillation with respect to the frame about a pivot axis which is substantially perpendicular to the drive-shaft axis of rotation;
   - a stripping blade mounted at a lower end of the bracket; and
   - a follower block rigidly secured to the bracket, the block having an oblong opening therein to receive the cam, the drive-shaft axis of rotation extending through the opening, the longer axis of the opening being substantially parallel to the bracket pivot axis and being sufficiently large that the ends of the opening remain clear of the rotating cam, the opening having upper and lower side surfaces which are substantially straight and parallel, the side surfaces being spaced apart by substantially the outside diameter of the cam whereby the cam makes a rotatable slip fit between the side surfaces and the bracket is oscillated about the pivot axis to reciprocate the stripping blade.

2. The machine defined in claim 1 wherein the bracket is shaped as a bell crank with the follower block secured adjacent one end and the blade secured adjacent the opposite end of the crank, the bracket pivot axis being positioned approximately on and normal to the drive shaft axis of rotation.

3. The machine defined in claim 2 wherein the frame includes a pair of plates extending along opposite sides of the bell-crank bracket to form a forked support for the bracket.

4. The machine defined in claim 3 wherein the bell-crank bracket comprises a pair of spaced-apart side plates which are connected by the follower block, a clamping jaw for the stripping blade, and a tubular member at the bracket pivot axis, and further comprising bearing means connecting the tubular member and the plates of the forked bracket support.

5. The machine defined in claim 4 wherein the cam includes a bearing member disposed between the eccentric peripheral surface and the follower block.

6. The machine defined in claim 5 wherein the cam has a radially extending flange at one end, and further comprising a fastener on the cam to secure the bearing member against the flange.

7. The machine defined in claim 6 wherein the frame includes an upwardly extending handle, and a rotatable wheel extending downwardly from the frame to support the machine on the surface.

8. The machine defined in claim 1 wherein the bracket includes a pivotally mounted stripping-blade clamping jaw, and further includes an elongated link which is pivotally secured to the bracket and jaw to form a four-bar linkage supporting the blade on the bracket.

* * * * *